United States Patent [19]

Becker

[11] Patent Number: 4,508,519

[45] Date of Patent: Apr. 2, 1985

[54] TOY BUILDING

[76] Inventor: James R. Becker, 303 E. 57th St., New York, N.Y. 10022

[21] Appl. No.: 455,469

[22] Filed: Jan. 4, 1983

[30] Foreign Application Priority Data

Aug. 1, 1982 [GB] United Kingdom ..... 8200482

[51] Int. Cl.[3] ..... A63H 3/52

[52] U.S. Cl. ..... 446/478; 446/76

[58] Field of Search ..... 46/12, 11, 13, 19, 18, 46/21

[56] References Cited

U.S. PATENT DOCUMENTS

| | | | |
|---|---|---|---|
| 1,258,788 | 3/1918 | Koch | 46/21 |
| 1,517,030 | 11/1924 | Talcott | 46/21 |
| 2,259,783 | 10/1941 | Sparling | 46/12 |
| 3,363,360 | 1/1968 | Ryan | 46/12 |
| 3,400,485 | 9/1968 | Callin et al. | 46/11 |
| 3,521,810 | 7/1970 | Boyer | 229/23 |
| 3,624,954 | 12/1971 | Van der Veken | 46/11 |
| 3,691,671 | 9/1972 | Kroll | 46/12 |
| 3,736,695 | 6/1973 | Wannan | 46/12 |
| 3,888,039 | 6/1975 | Snyder et al. | 46/12 |
| 3,973,356 | 8/1976 | Schacht | 47/41 |
| 4,030,234 | 6/1977 | Allen et al. | 46/12 |
| 4,193,221 | 3/1980 | Beck | 46/12 |
| 4,253,266 | 3/1981 | Bajo | 46/11 |
| 4,349,983 | 9/1982 | Kilroy et al. | 46/12 |

FOREIGN PATENT DOCUMENTS

| | | | |
|---|---|---|---|
| 343402 | 3/1931 | United Kingdom | 206/270 |
| 530466 | 3/1941 | United Kingdom | 206/45.12 |

*Primary Examiner*—Mickey Yu

*Attorney, Agent, or Firm*—F. Eugene Davis IV

[57] ABSTRACT

A toy building which is easily carried and yet which can form a larger size play unit. A first floor part 3 of the building is slidably received within a ground floor part 1. Clip elements 7 include lugs 21 and 23 slidable on rails 19 engage with respective projections 33 and 37 to locate the upper part 3 in its elevated position. The lug 23 is engageable with an upper projection 35 for locating the parts 1 and 3 in their collapsed positions.

26 Claims, 7 Drawing Figures

TOY BUILDING

DESCRIPTION

The present invention relates to a toy building.

An object of the present invention is to provide a small compact unit which can be easily carried around by a child and which can form a larger size play unit.

According to the present invention there is provided a toy building comprising at least first and second parts which are slidably received one within the other and at least one catch means for securing the said parts in the extended and collapsed position.

The toy building may take several forms, for example it may be a dolls house, an airport, a service station, a fire station, a supermarket or a barn. In any particular case the internal fittings and decoration and the external shape and decoration are determined by the particular form chosen.

In a preferred embodiment the catch means comprises a lug slidably received on a rail of one of the parts and adapted to be cooperable with an abutment on the other part. Preferably, sides of the second part are received slidably within sides of the first part. Both parts may be rectangular in plan and have respective bases which form ground and first floors of the building. That is to say when the second part is in its extended position it forms the first floor of the building. The rail is preferably formed by an upper edge of a side of the first part.

The building is preferably a two story building but it may have more stories by arranging for an additional part to be slidably received in the second part. Likewise further stories may be accommodated in a similar manner.

Conveniently, the second part has a hollow ridge roof which serves as a storage space. One half of the roof may be hinged along the line of the ridge. A carrying handle may be be pivotally secured to the ridge. Alternatively, the carrying handle may be of a drop handle type so that when the toy is not being carried the top of the carrying handle blends in with the roof and the extensions that form the handle are concealed in the attic space.

A portion of one or more sides of the first or second parts may be hinged or removable providing an opening to the interior where the portion of the side is hinged it may serve as an extension to the floor area when in its outwardly and downwardly pivoted position.

THE DRAWINGS

For a fuller understanding of the nature and objects of the invention, reference should be had to the following detailed description taken in connection with the accompanying drawings, in which.

The same reference characters refer to the same elements throughout the several views of the drawings.

BEST MODE FOR CARRYING OUT THE INVENTION

Figure 1:
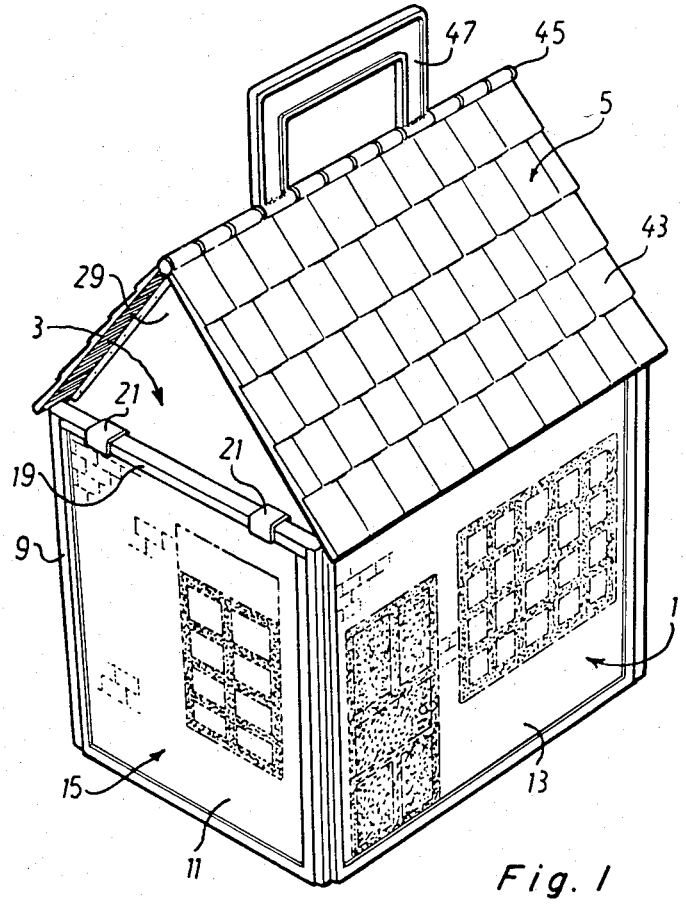
FIG. 1 is a perspective view of the toy building in its collapsed packed away position.
Figure 2:
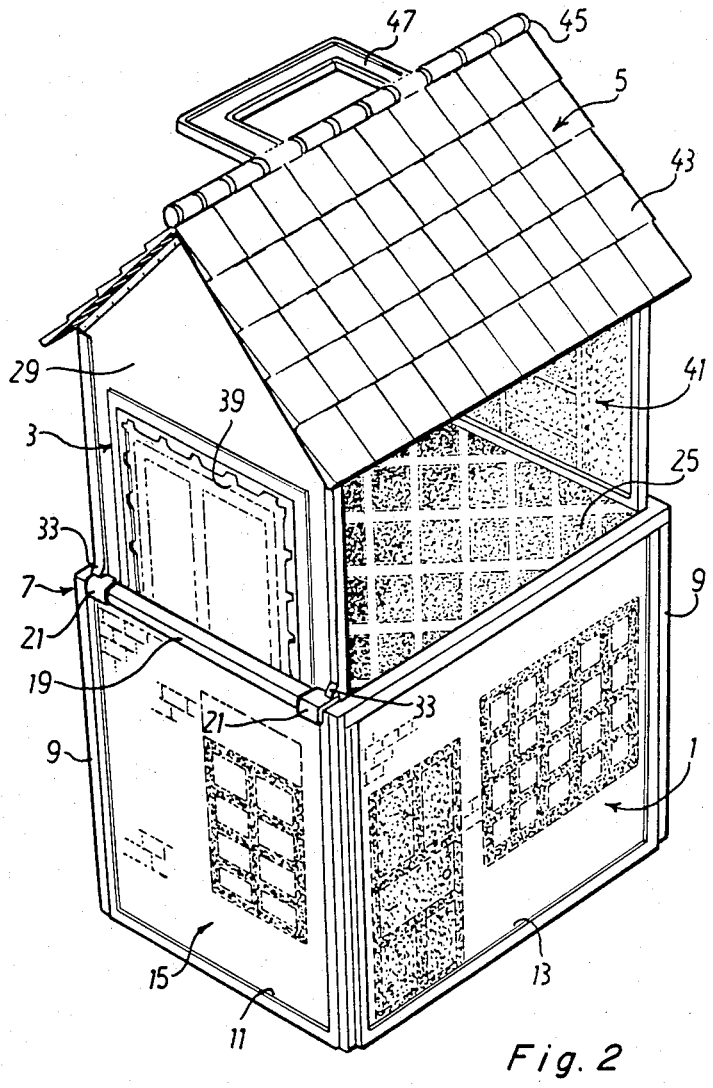
FIG. 2 is a perspective view of the toy building of FIG. 1 with the inner part in its raised position.
Figure 3:
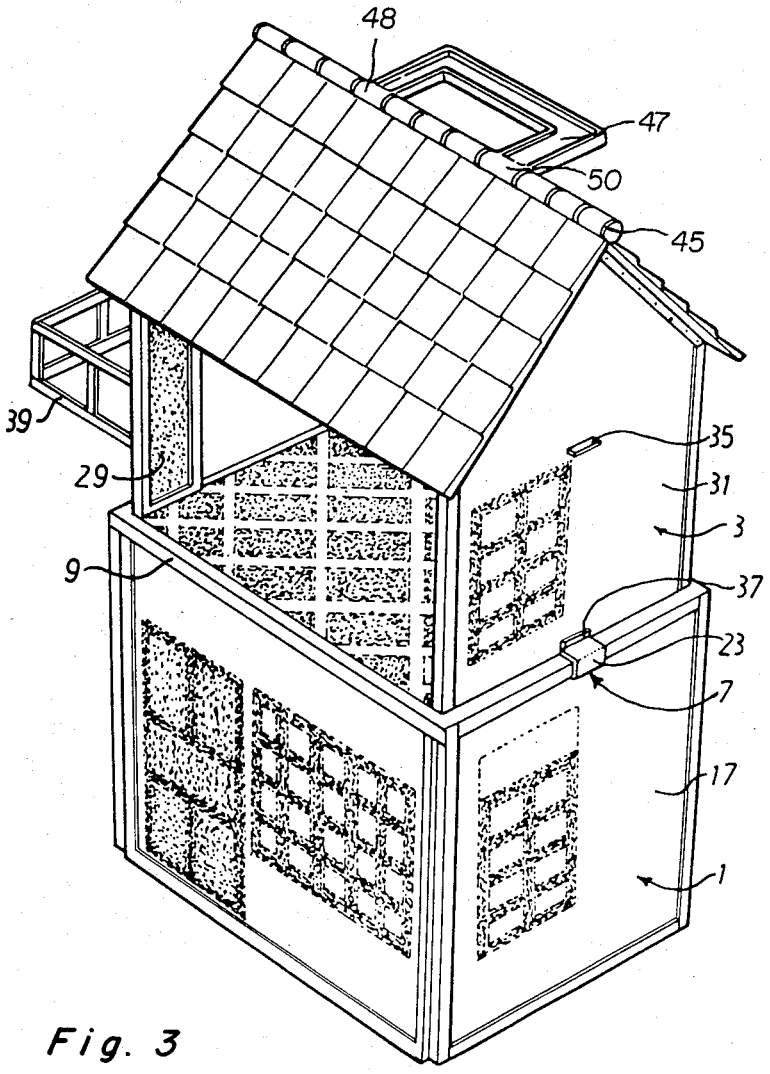
FIG. 3 is a perspective view showing the other end of FIG. 2.

Referring more particularly to the drawings, one embodiment of a toy building in the form of a dolls house is illustrated. The building is rectangular in plan and in the example is a two story building with a ridge roof 5&5'. In FIG. 1 the building is illustrated in its packed or collapsed position in which a second part 3 serving as the first floor is slidably received within a first part 1 serving as the ground floor of the building. FIG. 2 shows the first floor in its raised position. Catch means 7 is provided for locating the second part 3 in its elevated position. In the illustrated embodiment there are three catch means; two of which are illustrated in FIG. 2 and the third in FIG. 3.

Figure 4:
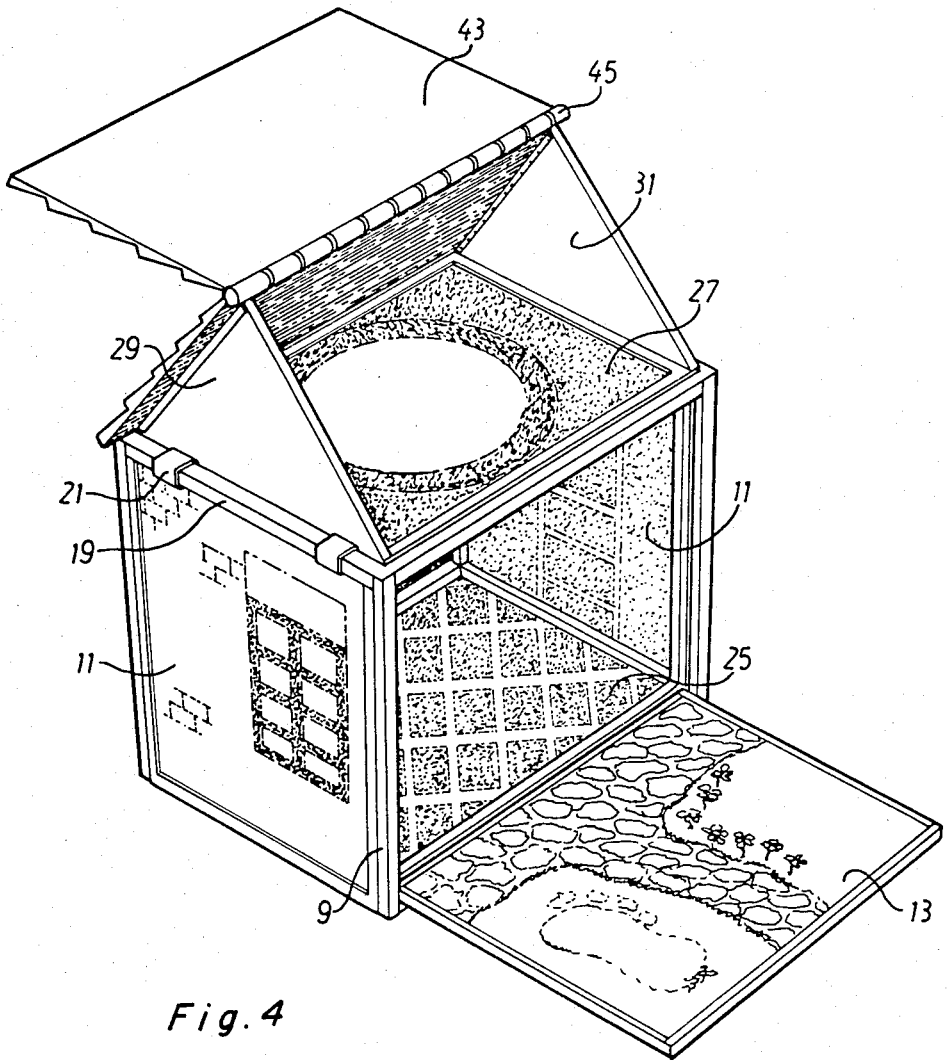
FIG. 4 is a perspective view similar to FIG. 1 with the front side lowered and the roof raised.

The ground floor comprises a three dimensional frame work 9 which defines four sides, a base and a top. The top within the frame work is open, that is to say not filled in, while three of the sides comprise fixed decorated panels 11 which fill in the frame work. The fourth side comprises a decorated panel 13 which is pivotably secured to the frame work 9. FIG. 4 shows the panel 13 in its outwardly pivoted position. That portion of the frame work 9 which forms the upper edge of the sides, or at least the two opposite end sides 15 and 17 serves as a rail 19 accommodating the clip means 7. The rail 19 at the end 15 carries slidably thereon two generally C-shaped lugs 21 while the rail 19 at the end 17 carries one slidable lug 23. The purpose of the lugs 21 and 23 will be described further hereinbelow.

The first floor or second part 3 is dimensioned to fit within the sides of the first part 1 in a slidable manner.

The second part 3 is generally rectangular in plan having a base 25 which, when the second part is in the extended position serves as the floor of the first story and the ceiling of the ground floor. The base 25 completely fills the floor area; that is to say it is rectangular as illustrated, but it may have apertures in it so that three dimensional objects on the ground floor, such as stairs or room dividers may be accommodated when the second part is collapsed within the first part.

The second part 3 is provided with a ceiling 27 and two opposite end sides 29 and 31 which are extended above the ceiling level to form gable ends for the ridge roof 5 and 5'. The end side 29 has at each of its lower corners, on the outside surface a projection 33. The projections 33 are positioned so that each of the slidable lugs 23 can be moved into engagement therewith when the second part 3 is in its elevated position. Thus the cooperation between the lugs and projections holds the second part 3 in its elevated position. The end side 31 is provided with upper and lower projections 35 and 37 disposed in the center of the side. The slidable lug 23 cooperates with the upper projection 35 when the second part is in its collapsed position to locate the parts in the collapsed position. The slidable lug 23 cooperates with the lower projection 37 when the second part is in its elevated position.

The end side 29 has, between the projections 33, a fold down flap 39 which, when in the folded down position serves as a balcony or extension to the first floor area. The side 41 of the upper floor is open to the interior as illustrated but it will be appreciated that any one of the sides may be either fixed, open or comprises a folding flap according to the requirements. Thus, for example, both end sides 29 and 31 may have folding flap portions in which case the centrally disposed projections 35 and 37 would be replaced by side projections 33 as per the end 29. An upper stop corresponding in function to the projection 35 may then be provided in the upper corners of the end 29.

FIG. 4 illustrates a further feature of the preferred embodiment wherein the roof space is hollow and one half 43 of the roof is hinged along the line of the ridge 45 to allow access to the roof space for storage.

The carrying handle 47 (FIG. 3) is provided with barrel portions 48 and 50 which are also slotted for assembly to hinge pin 53 and shaped like the ridge 45. That is, the roof part 5' has an integrally molded hinge pin 53 (see FIG. 5) and roof part 5 has an integrally molded barrel portion 46 forming the ridge 45 and slotted for assembly over the pin 53.

Further stories may be incorporated by providing three or more parts which fit one within the other.

Figure 5:
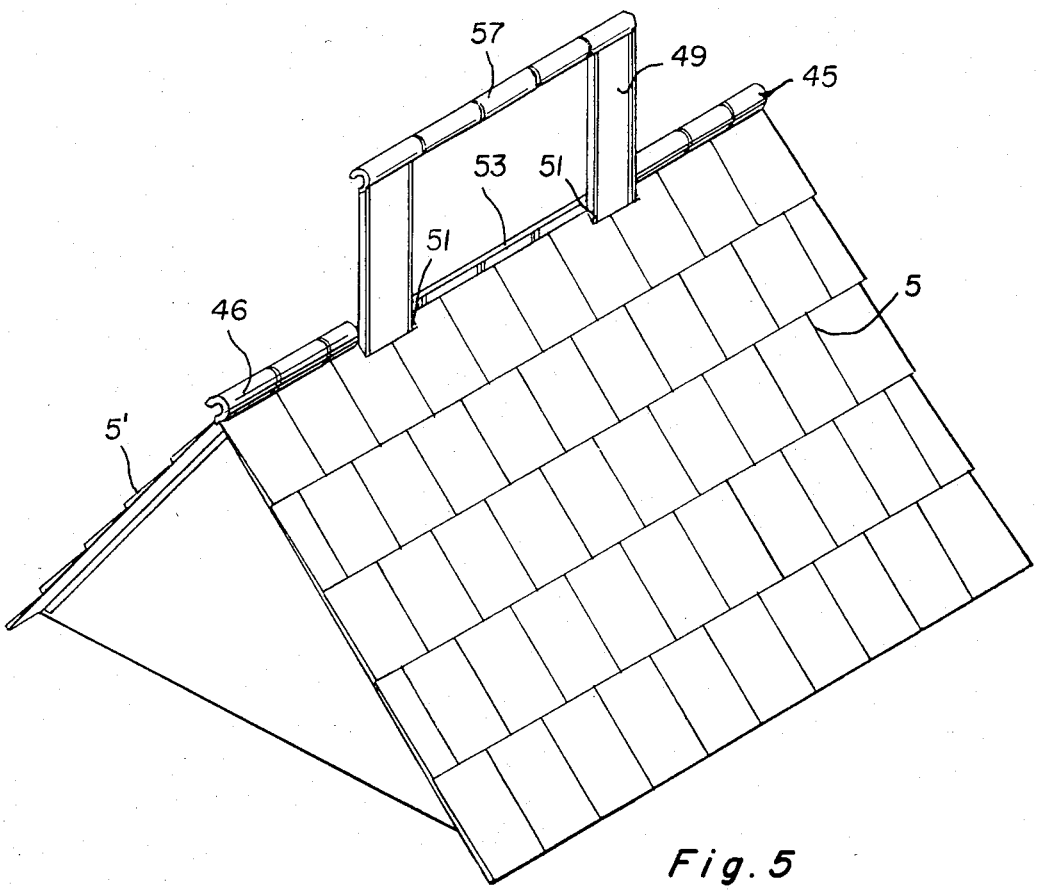
FIG. 5 is a perspective view of an alternative embodiment showing a carrying handle of the drop handle type in its raised position.

FIG. 5 illustrates an alternate embodiment of the carrying handle. The carrying handle 49 is contoured at 57 having a hinge shape so as to blend in with the roof. The extensions that form this handle 49 are received slidably within the roof part through slots 51 in the roof. The center area of the roof has several barrels, that form the hinged roof, removed in order to receive the carrying handle 49 flush with the roof.

The hinge pin 53 forming the hinge 45 is integrally molded with the roof part 5'.

Figure 6:
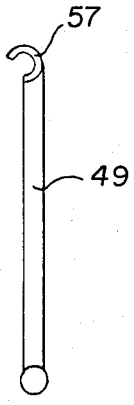
FIG. 6 is an enlarged side view of the carrying handle illustrated in FIG. 5.

FIG. 6 illustrates the carrying handle 49 of FIG. 5 from the side.

Figure 7:
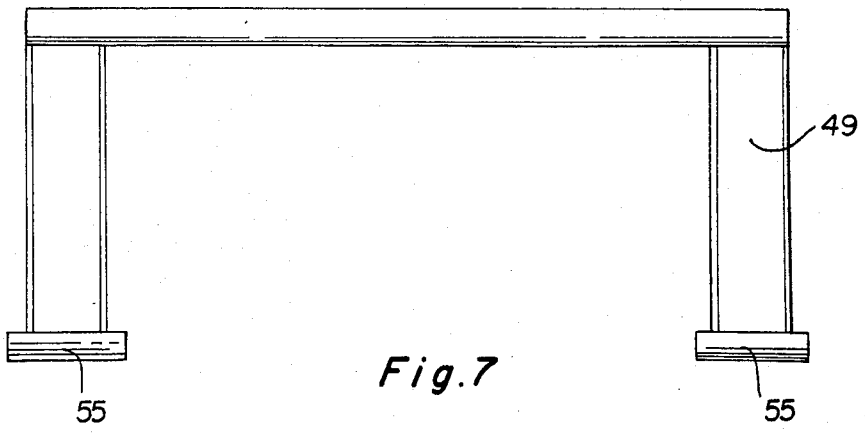
FIG. 7 is an enlarged frontal view of the carrying handle illustrated in FIG. 5.

FIG. 7 illustrates the carrying handle 49 separated from the toy. The knobbed ends 55 of the carrying handle 49 secures the carrying handle to the roof parts 5 & 5'.

Other embodiments are envisaged in which the building takes the form of an airport hanger/terminal building, a service station, a fire station, a supermarket or a barn. The shape of the building in plan may be round, polygonal or any other desired shape. The toy is preferably made from laminated card and/or injection moldings.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A multi-story toy building which is vertically expandable comprising at least first and second parts which are vertically slidably received one within the other, each of said parts comprising at least one story of the building and when extended forms a multi-story building, and catch means for securing the said parts in the extended and collapsed position comprising a lug slidably received on a rail of one of the parts and adapted to be cooperable with an abutment of the other part.

2. A toy building as claimed in claim 1 in which at least one side of the first or second parts has a portion opening to the interior of the respective first or second part.

3. A toy building as claimed in claim 1, in which sides of the second part are received slidably within sides of the first part, the second part being adapted to form a first floor of the building when extended and the first part serving as the ground floor.

4. A toy building as claimed in claim 1 or 3, in which the rail constitutes an upper edge of a side of the first part and the rail carries at least one slidable lug.

5. A toy building as claimed in claim 3 in which each part is rectangular in plan.

6. A toy building as claimed in claim 3 in which two opposite end sides carry the catch means.

7. A toy building as claimed in claim 3 in which at least one side of the first or second parts has a portion opening to the interior of the respective first or second part.

8. A toy building as claimed in claim 7, in which said portion is a hinged side portion which, when in its outwardly hinged position, forms an extension of the floor area of the building.

9. A toy building as claimed in claim 3 in which the first and second parts have respective base portions which form the ground and first floors respectively of the building.

10. A toy building as claimed in claim 1 further comprising a roof part which is hollow and serves as a storage space.

11. A toy building as claimed in claim 10, in which the roof is an additional part which is removably secured to the second part.

12. A toy building as claimed in claim 10, in which the roof is a ridge roof, one half of which is hinged to gain access to the roof space.

13. A toy building as claimed in claim 12, in which the ridge forms the hinge for the roof half and for a carrying handle.

14. A toy building as claimed in claim 10, and a carrying handle in which extensions that form the carrying handle are received slidably within the roof part and are concealed in the attic space and the top of the carrying handle is flush with the roof when carrying handle extensions are concealed in the attic space, means at the ends of the carrying handle for securing the carrying handle to the roof part.

15. A toy building as claimed in claim 12 and a carrying handle in which extensions that form the carrying handle are received slidably within the roof part and are concealed in the attic space and the top of the carrying handle being shaped like the hinge of the roof so that the carrying handle is flush with the roof when carrying handle extensions are concealed in the attic space, means at the ends of the carrying handle for securing the carrying handle to the roof part.

16. A toy building as claimed in claim 1 in which the building is in the form of a building chosen from the group consisting of a dolls house, an airport, a service station, a fire station, a supermarket and a barn.

17. A toy building as claimed in claim 1 in which each part is rectangular in plan.

18. A toy building as claimed in claim 1 in which two opposite end sides carry the catch means.

19. A toy building as claimed in claim 1 in which the first and second parts have respective base portions which form the ground and first floors respectively of the building.

20. A toy building as claimed in claim 19 further comprising a roof part which is hollow and serves as a storage space.

21. A toy building as claimed in claim 20 in which the roof is an additional part which is removable secured to the second part.

22. A toy building as claimed in claim 20 in which the roof is a ridge roof, one half of which is hinged to gain access to the roof space.

23. A toy building as claimed in claim 22 in which the ridge forms the hinge for the roof half and for a carrying handle.

24. A toy building as claimed in claim 20 and a carrying handle in which extensions that form the carrying handle are received slidably within the roof part and are concealed in the attic space and the top of the carrying handle is flush with the roof when carrying handle extensions are concealed in the attic space, means at the ends of the carrying handle for securing the carrying handle to the roof part.

25. A toy building as claimed in claim 22 and a carrying handle in which extensions that form the carrying handle are received slidably within the roof part and are concealed in the attic space and the top of the carrying handle being shaped like the hinge of the roof so that the carrying handle is flush with the roof when carrying handle extensions are concealed in the attic space, means at the ends of the carrying handle for securing the carrying handle to the roof part.

26. A toy building as claimed in claim 25 in which the building is in the form of a building chosen from the group consisting of a dolls house, an airport, a service station, a fire station, a supermarket and a barn.

* * * * *